United States Patent [19]

Yost

[11] 3,973,172

[45] Aug. 3, 1976

[54] SURGE ARRESTER OF THE MULTI-GAP TYPE

[75] Inventor: Arnold G. Yost, Barberton, Ohio

[73] Assignee: The Ohio Brass Company, Mansfield, Ohio

[22] Filed: Nov. 11, 1974

[21] Appl. No.: 522,350

[52] U.S. Cl. ..... 317/61; 317/68; 317/70

[51] Int. Cl.² ..... H01T 5/02

[58] Field of Search ..... 317/61, 67, 68, 70; 313/204, 205, 353; 315/36

[56] References Cited

UNITED STATES PATENTS

| | | | |
|---|---|---|---|
| 1,017,648 | 2/1912 | Chapman et al. | 313/353 |
| 2,623,192 | 12/1952 | Kalb | 317/70 |
| 2,640,096 | 5/1953 | Kalb | 317/68 |
| 2,648,796 | 8/1953 | Manke | 313/353 |
| 3,524,099 | 8/1970 | Stetson | 317/70 |
| 3,869,650 | 3/1975 | Cunningham et al. | 317/61 |

FOREIGN PATENTS OR APPLICATIONS

| | | | |
|---|---|---|---|
| 605,793 | 7/1948 | United Kingdom | 317/68 |

*Primary Examiner*—J D Miller
*Assistant Examiner*—Harry E. Moose, Jr.
*Attorney, Agent, or Firm*—Bosworth, Sessions & McCoy

[57] ABSTRACT

A surge arrester of the multi-gap type made up of a series of gap units and a non-linear resistance disposed in a conventional porcelain housing. The gap units comprise a series of metal electrodes in the form of thin discs or plates arranged in a stack and spaced by ceramic insulating studs or posts; a surface of at least one of the electrodes in each gap unit, except in the area where the sparkover is to take place, is insulated to prevent wandering of the arcs over the surfaces of the plates to the edges of the plates where sparkover might take place along or across the edges of the whole series of plates making up the arrester. Such an action would greatly reduce the voltage of the multi-gap almost to the voltage of a single gap instead of an entire series of gaps. By eliminating this danger of wandering, the diameter of the plates can be substantially reduced, thus reducing the size and cost of the entire arrester assembly.

19 Claims, 10 Drawing Figures

SURGE ARRESTER OF THE MULTI-GAP TYPE

BACKGROUND OF THE INVENTION

This invention relates to surge arresters (also known as lightning arresters and surge diverters) and more particularly to surge arresters of the multi-gap type that are used extensively in electrical systems of moderate voltages, say from 2.4 kv to 34.5 kv and sometimes on up to 100 kv. Arresters of this type are used in large numbers to protect transformers and other items of equipment in electric power distribution systems. They function to divert voltage surges of more than a predetermined value harmlessly to ground, thus protecting the equipment with which they are associated from excessive voltages, whether the voltage is derived from a lightning stroke or from another surge such as a switching surge or the like. The arresters must function very promptly to sparkover at the desired voltage and then, when the surge has been dissipated, must promptly shut off the power follow current that would otherwise continue to flow to ground. After the power follow current has been shut off the arresters must again be ready to resume their protective function of diverting surges to ground.

In general such arresters comprise a series of elements providing a plurality of spark gaps disposed within a porcelain housing which also contains a nonlinear resistance usually made up of a plurality of nonlinear resistors commonly called "valve blocks." The valve blocks are interposed in the circuit between a line to be protected and ground in series with the spark gap units. Sufficient gap units of proper dimensions are employed to produce the desired sparkover voltage. Upon sparkover, the voltage drop across the gaps is reduced very promptly and under the high voltage and current conditions of a lightning stroke or other surge the resistance of the valve blocks is also low so that the total voltage drop across the arrester is below the protective level required for the apparatus with which the arrester is associated. In simple multi-gap arresters of this type the power follow current is ordinarily shut off at the first current zero after the passage of the surge that caused the arrester to become conductive. The construction must be such that the arc will not restrike in the arrester under normal power system voltage even though the housing of the arrester may contain ionized gas.

Multi-gap arresters are known that are made up of a series of metal plate electrodes spaced apart by insulating studs or spacers to provide arc gaps. Arresters of this type are useful for moderate voltage services. The stack of electrodes making up the gap units and the valve block or blocks are enclosed in a porcelain housing, one end of which is connected to a conductor of the system and the other end of which is connected to ground. These arresters have been successful but have presented problems in that after sparkover the arcs tend to wander over the faces of the metal plates and may reach the edges of the metal plates with the result that the entire arrester can sparkover in a continuous arc extending from one end of the stack of plates to the other. The presence of such an arc greatly reduces the voltage drop across the gaps as compared to the usual voltage drop across the plurality of gaps and may even reduce the voltage drop to a value little more than the value of the voltage drop across a single one or a few of the gaps of the arrester. This makes it more difficult for the arrester to shut off at current zero and makes it more likely that the arrester will restrike as the voltage of the power system increases beyond current zero. For this reason it has been necessary to use discs of comparatively large diameter which results in an increase in costs in the discs and an increase in the cost, size and weight of the enclosure.

Various means have been proposed to prevent the arcs from wandering to the edges of the plates and to prevent the extension of the arcs along the edges of the entire stack. See, for example, U.S. Pat. Nos. 2,888,608, 2,623,192 and 3,660,725. These constructions all add to the cost, bulk and weight of the arresters. It has also been proposed to provide multi-gap arresters embodying ceramic or porcelain plates with electrodes mounted on either side of them and the plates arranged in a stack. Because of the thickness of the plates and the cost of the material such arresters are bulky and more expensive than arresters embodying thin metal plate electrodes.

SUMMARY OF THE INVENTION

A general object of the present invention is to provide an improved multi-gap arrester that reduces or substantially eliminates the above-mentioned difficulties and which can be manufactured at lesser cost and will give improved service as compared to prior arresters of the same general type. Another object is the provision of an arrester that is more compact and lighter for a given service than arresters of the multi-gap types heretofore known to me. Other objects and advantages of the invention will become apparent from the following description of a preferred form thereof, the essential characteristics being summarized in the claims.

Briefly, the invention comprises the provision of a surge arrester consisting of a stack of electrode plates to provide a series of arc gap units. The plates in the stack are separated by spacers or buttons of insulating material such as porcelain or steatite; the stack is preferably enclosed in a porcelain housing which also contains one or more series-connected valve blocks. In order to prevent the arcs from wandering after sparkover and thus possibly reaching the edges of the metallic discs in the stacks and sparking over several of all of the gap units in the arrester and reducing the gap voltage materially, a surface of at least one of the metal electrode discs in the gap units is insulated as by disposing a disc of insulating fiber over the surface or by coating the surface with insulating material. By thus preventing the arcs from wandering, the diameter of the disc can be substantially reduced for an arrester of a given voltage. Since the disc diameter is reduced, the housing diameter and weight are also reduced and economies in manufacture, shipment and mounting are attained. Reduction in the wandering of the arcs also prevents the arcs from restriking and makes possible the use of arresters made according to the present invention in services more severe than the service to which previous arresters embodying multi-gap units made up of stacks of spaced metal plates are adapted.

DESCRIPTION OF PREFERRED EMBODIMENTS

Figure 1:
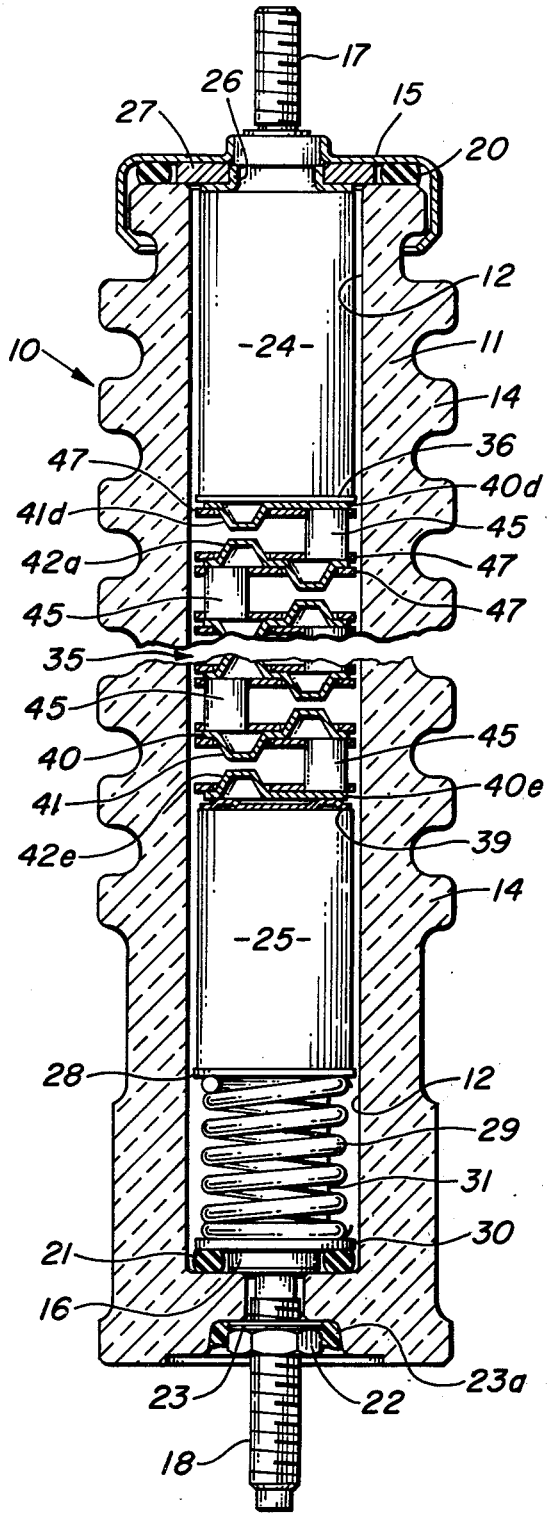
FIG. 1 is an axial sectional view of a preferred form of surge arrester embodying the present invention.

A preferred form of surge arrester made according to the present invention is indicated in general at 10 in FIG. 1 of the drawings. As there shown the arrester 10 may comprise a cylindrical bore 12 in which the operative elements of the arrester are disposed. The housing 11 may be of any suitable or conventional construction; the body of the housing preferably includes integrally formed annular corrugations 14 and the ends of the housing are closed by metallic end members 15 and 16 that are sealed to the ends of the porcelain housing by conventional sealing means. The end members 15 and 16 are provided with means such as the threaded bolts shown at 17 and 18 for mounting the arrester when it is in service and also for connection to the circuit to be protected and ground. Ordinarily the end bolt 17 is connected to one of the phase conductors of the circuit to be protected and the bolt 18 is connected to an appropriate ground. The end members 15 and 16 are sealed to the porcelain housing 11 by conventional sealing means such as the O-rings 20 and 21. At the bottom end of the arrester, the member 16 is clamped in engagement with the housing by a jam nut 22 that engages a washer 23. a sealant 23*a* engaging the housing, washer and jam nut.

The operative elements of the surge arrester are enclosed within the circular cylindrical bore 12 and include non-linear resistance elements 24 and 25, these elements being the usual "valve blocks" widely used in surge arresters. The elements are connected between the upper and lower end members in series with a gap assembly made up of the several gap elements which are described below. The upper valve block 24 engages a flanged contact disc 26 which is in contact with a retainer ring 27 that makes an electrical connection with the upper end member 15. A generally similar arrangement is employed at the bottom of the arrester, a metal contact disc 28 being disposed beneath the lower valve block 25 in engagement with a spring 29, which in turn makes electrical contact with a plate 30 that engages the upper side of the lower end member 16. The spring 29 maintains the parts of the assembly in contact with each other. Preferably a low resistance shunt 31 is connected in parallel with the spring 29.

The spark gap assembly indicated in general at 35 is disposed between the bottom of the upper valve block 24 and the top of the lower valve block 25. A metal plate 36 makes electrical contact with the under side of valve block 24 and the plate also makes contact with the top electrode of the spark gap assembly 35. At the bottom of the spark gap assembly 35 there is another metal plate 39 that makes electrical contact with the top of valve block 25. The upper side of plate 39 is in electrical contact with the lowermost electrode of the gap units making up the gap assembly 35. Thus, in service the two valve blocks and the gap assembly 35 are connected in series between a phase conductor and ground and are associated with an item of equipment to be protected in the usual manner.

Figure 2:
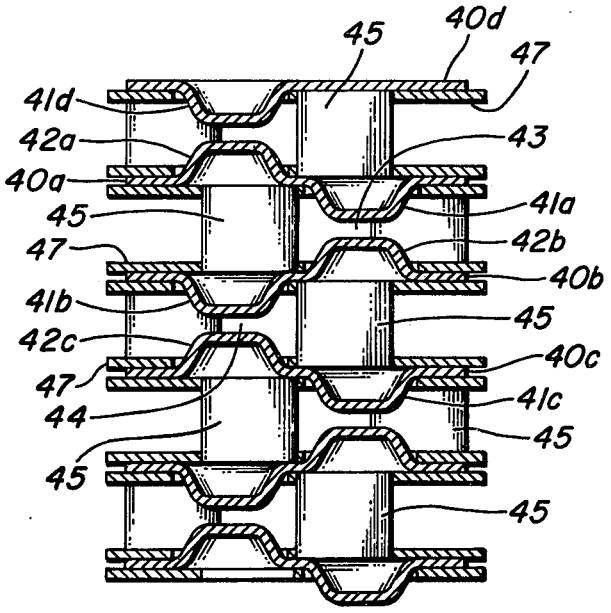
FIG. 2 is a sectional detail to an enlarged scale showing a few of the gap units embodied in the arrester of FIG. 1.
Figure 3:
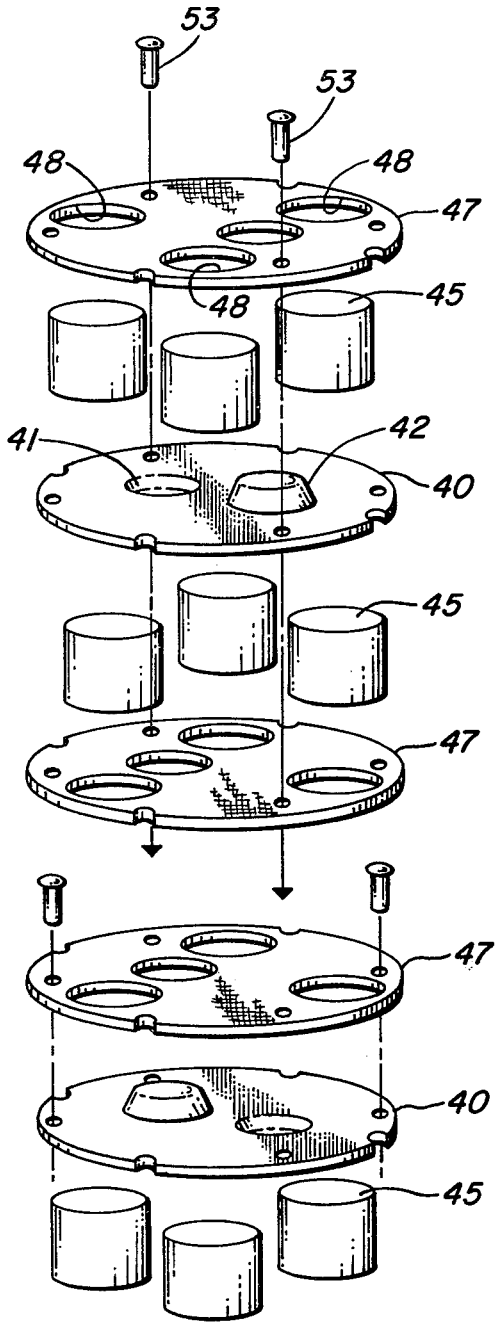
FIG. 3 is an exploded view illustrating the elements making up the gap units of FIG. 2.
Figure 5:
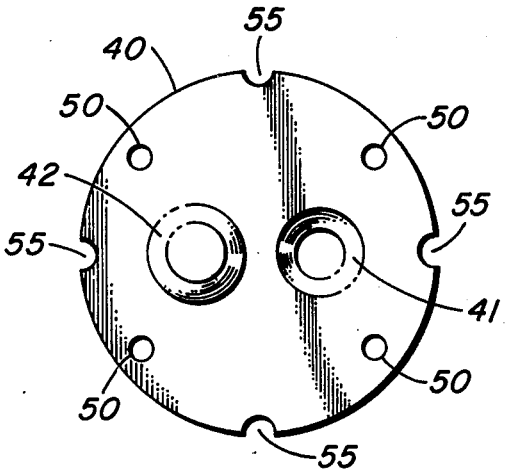
FIG. 5 is a top plan view of one of the metal electrodes utilized in the gap units.
Figure 6:
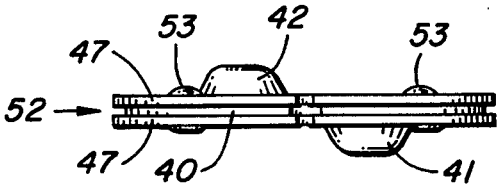
FIG. 6 is a sectional view of a sub-assembly incorporating one of the intermediate electrodes of the gap assembly.

In order to provide a compact, economical and reliable spark gap assembly, in a preferred form of the invention the assembly 35 is made up of a series of metal plates or electrodes designated in general by reference numeral 40, and some being specifically identified by reference characters 40*a*, 40*b*, 40*c* and 40*d*. These electrodes are spaced apart by insulating spacer members and are provided with projecting portions that cooperate to form a series of spark gaps when the electrodes are assembled in a stack. As shown particularly in FIGS. 2 and 5, each electrode 40 consists of a disc of fairly thin metal, such as brass, having a thickness for example, of about 0.040 inch, and preferably of circular periphery. Each intermediate electrode has two spaced, oppositely extending projections 41 and 42 preferably disposed on a diameter of the electrode. As shown in FIGS. 2 and 6, projection 41*a* extends downwardly and projection 42*a* extends upwardly in the electrode 40*a*. When such an electrode is assembled in proper juxtaposition to another substantially identical electrode, such as electrode 40*b* in FIG. 2, the upwardly extending projection 42*b* of electrode 40*b* cooperates with the downwardly extending projection 41*a* of electrode 40*a* to define a spark gap 43. Similarly, the downwardly extending projection 41*b* of electrode 40*b* cooperates with the upwardly extending projection 42*c* of the next adjacent electrode 40*c* to define a spark gap 44, and downwardly extending projection 41*c* will cooperate in similar fashion with another similar electrode disposed below it, while upwardly extending projection 42*a* of electrode 40*a* will similarly cooperate with a downwardly extending projection on the adjacent uppermost electrode 40*d*. A similar relationship obtains between the successive intermediate electrodes in the stack.

In the case of the uppermost electrode 40*d*, only one downwardly extending projection 41*d* is provided, which forms a gap with the upwardly extending projection 42*a* of the electrode 40*a* immediately beneath the electrode 40*d*. The generally flat upper surface of the electrode 40*d* makes contact with the metal plate 36 (see FIG. 1), plate 36 being in electrical contact with the lower end of valve block 24. Likewise, the single upwardly extending projection 42*e* of the lowermost electrode 40*e* opposes and forms a gap with a downwardly extending projection 41 on the electrode 40 immediately above it, while the generally flat under surface of the electrode 40*e* makes contact with and is supported by the plate 39 that is disposed on the upper surface of valve block 25. It is to be noted that electrodes 40*d* and 40*e* can be identical, but they are oppositely oriented in the assembly.

In the assembled arrester the electrodes are arranged as shown in FIGS. 1 and 2 with an upper electrode plate or disc 40*d*, a series of intermediate electrodes 40*a*, 40*b*, etc., and a bottom electrode 40*e*. The projections on each electrode are disposed opposite to and cooperate with a projection on an adjacent electrode to provide a gap so that the assembly provides a series of gaps. The electrodes are spaced by cylindrical spacers or buttons 45 disposed between adjacent electrodes. The width of the gaps between opposed projecting portions of the electrodes, such as the gaps 43 and 44, is determined by the distance that the projections extend above or below the plane of electrode plates and by the length of the spacers 45. Both of these dimensions can be controlled with a good degree of accuracy so that the sparkover distance of the gaps can also be controlled accurately. These spacers or buttons can be made of any appropriate insulating material, steatite being satisfactory. The buttons are preferably cylindrical in shape and their end faces may be ground accurately so that the axial length of the buttons is accurately controlled and the opposite faces of the buttons are substantially parallel to each other.

Figure 4:
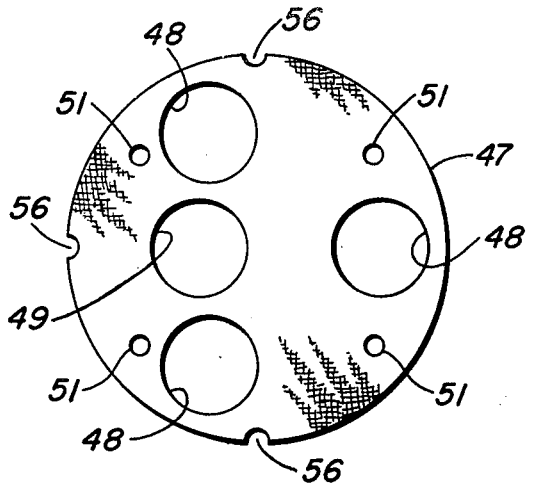
FIG. 4 is a top plan view of one of the insulating discs utilized in the gap units.

As noted above, problems have been encountered with arresters of this general type because of the fact that arcs may not remain in the sparkover zone, but may tend to wander over the faces of the electrodes and may extend to the edges thereof. If this occurs the entire series of gaps may arc over in one continuous arc. According to the present invention this difficulty is prevented by insulating the surface of at least one of the electrodes 40 in each gap unit in the area surrounding the projections 41 and 42. That is, at least one of the electrodes in each gap unit has an insulating surface except in the area where sparkover takes place and the area immediately adjacent thereto, this total area being referred to herein as the sparkover zone. Insulation may be accomplished by coating the electrodes, except for the projections 41 and 42, with an insulating material inasmuch as the insulation is not required to have a very high dielectric strength because of the fact that the voltage drop across each gap in the series of gaps after sparkover is low; for example, the voltage drop may be of the order of 20 or 30 volts across each gap. While insulating coatings could be employed, according to the preferred form of the invention the insulation is provided by insulating barriers in the form of discs 47 (see FIG. 4). The discs are circular and are composed of an insulating fiber of the like. The discs are relatively thin having, for example, a thickness of about 0.031 inch and the diameter of the discs is slightly greater than the diameter of the electrode plate as shown in the drawing. Each disc 47 has three openings 48 to receive and locate the spacer studs or buttons 45 and another opening 49 through which one of the projections 41 or 42 projects.

Figure 7:
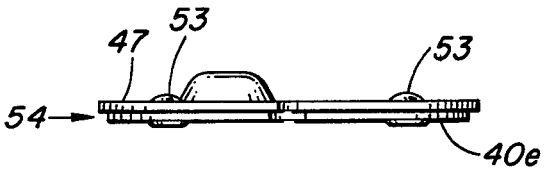
FIG. 7 is a sectional view of a sub-assembly embodying one of the end electrodes of the gap assembly.

In order to provide for ease of assembly of the complete gap unit, the intermediate electrodes 40, the end electrodes 40*d* and 40*e*, as well as the insulating barrier discs 47 are provided with registering openings 50 and 51. Prior to the completion of the assembly of the arrester, the sub-assemblies shown in FIGS. 6 and 7 are produced. The sub-assembly indicated in general at 52 and shown in FIG. 6 is composed of an intermediate electrode 40 and two barrier discs 47, one disposed on either side of the electrode 40; the assembly being held together by small rivets 53 that extend through the registering openings in the electrode and the barrier discs. One of the end sub-assemblies is shown in general at 54 in FIG. 7. These sub-assemblies are made up of one of the end electrode plates 40*d* or 40*e* to which one of the barrier discs 47 is secured by rivets 53. Producing these sub-assemblies in advance of the assembly of the entire gap unit facilitates assembly of the unit. It is to be noted that the openings 48 in the barrier discs which receive the spacers, buttons or studs 45, serve properly to orient adjacent electrodes 40 with respect to each other so that the upwardly and downwardly extending projections 41 and 42 are accurately located opposite each other.

The barrier discs 47, as shown in the drawing, are preferably slightly larger in diameter than the electrodes. The barrier discs are dimensioned to lightly engage the interior bore 12 of the porcelain housing 11 to insure proper axial alignment of the gap units and, furthermore, the slight extension of the barrier discs beyond the electrodes provides additional assurance that sparkover will not occur across the edges of the electrodes.

Preferably, as shown, the electrodes 40 and discs 47 are provided with peripheral notches 55 and 56. These are utilized in the assembly operation to assist in the handling and orientation of the discs.

After the sub-assemblies and other components of the arrester have been properly disposed within the housing, the arrester may be completed in the usual manner by charging the housing with gas, if desired, and sealing the end members to the housing.

For services up to about 15 kv, an assembly such as described is entirely satisfactory and for such services electrodes having a diameter of 1,375 inch are not subject to failure by wandering of the arcs when the electrodes are provided with barriers as described. For higher voltage services, up to for example, about 34.5 kv, the same diameter may be employed but it may be desirable to incorporate grading resistors in the gap assembly. This can be accomplished economically with arresters embodying the present invention by making one of the spacing buttons between each pair of electrodes out of an appropriate resistive material having the desired resistance to provide the grading. The nature of the grading resistors required is known to those skilled in the art.

Figure 8:
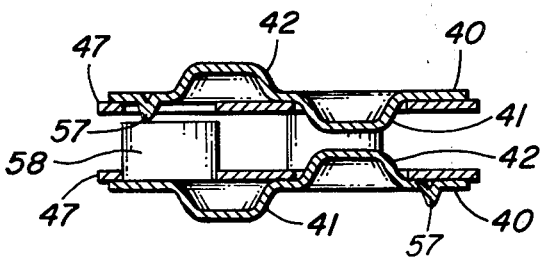
FIG. 8 is a fragmentary detail illustrating a preionizing gap that may be included in surge arresters embodying the invention, if desired.

Furthermore, if desired, as shown in FIG. 8 pre-ionizing gaps may be provided in order to secure a more uniform sparkover voltage when the arrester is subject to a lightning or other surge. This is accomplished by providing a small projection 57 on one side, preferably the lower side, of each electrode plate and having this projection oriented so that in the assembly it will lightly contact one of the spacer buttons such as the spacer button 58 shown. In the assembled arrester each such spacer button 58 is shortened with respect to the other spacer buttons 45 with which it is associated between electrodes by an amount substantially equal to the amount by which the projection 57 extends downwardly from the surface of the electrode in which it is formed. This assures light contact between the projection 57 and the short button 58 and provides a pre-ionizing gap which will result in more uniform sparkover of the associated gap between the projections 41 and 42 adjacent the pre-ionizing gap.

Figure 9:
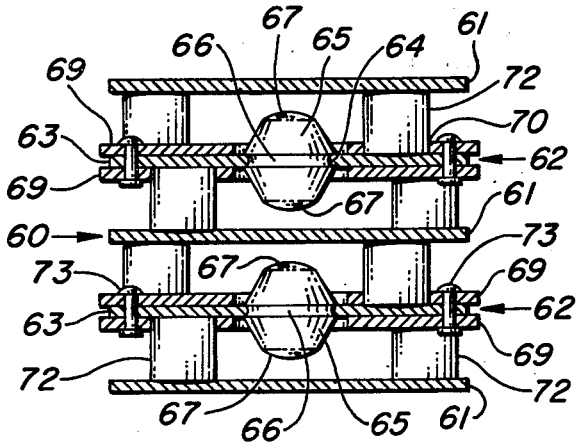
FIG. 9 is a sectional detail to the same scale as FIG. 2 and illustrating gap units of a modified type.
Figure 10:
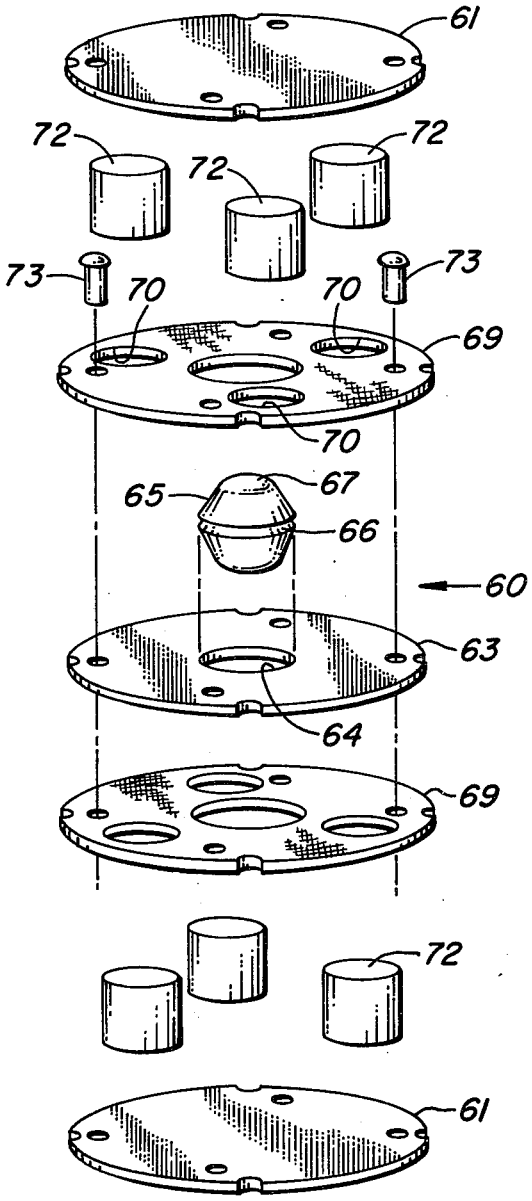
FIG. 10 is an exploded view illustrating the elements making up the gap units of FIG. 9.

Gap units embodying another preferred form of the present invention are illustrated in FIGS. 9 and 10 of the drawings. These figures illustrate gap units and the elements making up the units which, as compared to the previously described gap units, are modified (i) in that alternate electrodes take the form of flat plates; (ii) the projections are provided by separately formed buttons secured to and extending through one of the electrode plates, and (iii) the surface of only one of the electrodes in each gap unit is insulated. Thus, the gap units illustrated in general at 60 in FIGS. 9 and 10 are made up of flat metal electrode plates 61 which alternate with electrode assemblies 62 to provide the series of gap units. Each assembly 62 comprises a round, flat metal plate 63 having an opening 64, preferably disposed centrally thereof, in which a metal electrode button 65 is secured. The button may be secured in any convenient manner. In the preferred form shown in the drawing the button comprises a unitary metal member 65 having a central circumferential groove 66 and convex end surfaces 67. The button is dimensioned to be snapped into the aperture 64 in the electrode plate 63 with the edge of the opening 64 firmly engaging the groove 66 and the convex surfaces 67 disposed equidistantly from the surface of the plate after assembly.

The surfaces of the plate 63 surrounding the projecting portions of button 65 on either side of the plate are insulated by fiber insulating discs 69 which are generally similar to the discs 47 previously described. These discs are apertured centrally to receive the projecting portions of the buttons 65 and are also apertured as at 70 to receive spacer buttons 72 which preferably are similar to the previously described spacers 45. Two of the insulating discs 69 are secured to each electrode 63 by means of small rivets 73 that extend through registering openings in the plate 63 and the discs 69. These parts, when secured together, thus provide a sub-assembly such as the previously described sub-assembly 52 illustrated in FIG. 6. Gap units of the type just described may be assembled in a stack embodying the required number of spark gaps and disposed in a housing along with the usual valve blocks. The arrester assembly, aside from the difference in the details of construction of the gap units, may be similar in all material respects to the arrester assembly illustrated in FIG. 1 of the drawings.

It is to be noted that if desired one or more of the spacing studs in some or all of the gap units can be composed of a resistive material to provide resistance grading for the arrester. Also, if desired, pre-ionizing gaps as illustrated in FIG. 8 may be incorporated in the gap assemblies.

It will be evident that in lieu of the flat plate electrodes 61, the gap units may be made of a series of assemblies such as the assemblies 62 with flat plate electrodes at the ends of the stack of gap units. Also, if desired, insulating discs can be positioned on the flat plate electrode members, the insulating discs in that event being apertured in the sparkover zone, i.e., centrally in the area opposite the sparking surfaces 67 of the buttons 65; such discs would also be apertured to receive the spacer buttons 72.

Those skilled in the art will appreciate that electrode plates such as the previously described electrode plates 40 and sub-assemblies such as the sub-assembly 52 shown in FIG. 6, may be used with intermediate flat electrode plates and also that in the previously described form of the invention it may be satisfactory in some instances to provide an insulating barrier such as a fiber disc for only one of the electrode surfaces in each gap assembly. In other words, it is contemplated that further modifications in the invention can be made by incorporating such features of the two preferred forms described herein as may be desired or expedient. Thus, for some purposes, stamped electrodes may be advantageous whereas for other purposes electrodes with the separately formed metallic projections may be preferred, perhaps for the reason that with such electrodes, the gap, being located at the center of the electrode disc, is spaced farther from the edge of the disc for a given diameter of disc than is possible with stamped electrode discs that embody spaced, oppositely extending projections.

From the foregoing it will be evident that the invention provides economical and advantageous surge arresters particularly adapted for distribution services at the voltages usually encountered in such services. Because of the provision of the barriers on the arrester electrodes, the risk of sparkover of the entire arrester is minimized and for a given service electrode discs and the entire arrester housing can be made of smaller diameters than were possible heretofore. Arresters of this type can be adapted for more severe services than the usual distribution arrester by utilizing the spacing studs as grading resistors and also by the provision of pre-ionizing gaps as described. Thus the invention provides reliable and relatively inexpensive surge arresters that can be adapted to a wide range of voltages and operating conditions.

Those skilled in the art will appreciate that various changes and modifications can be made in the preferred forms of the arrester disclosed herein without departing from the spirit and teachings of the invention. The scope of the invention is defined by the appended claims.

I claim:

1. A surge arrester having a valve block, a gap assembly in series with the valve block and providing a plurality of spark gaps in series, said gap assembly comprising a plurality of aligned gap units disposed in a stack, each gap unit embodying two metallic disc electrodes having opposed surfaces, insulating spacer members interposed between adjacent electrodes for spacing the electrodes a predetermined distance from each other in the stack, at least one electrode of each gap unit having a projection disposed in opposition to a conductive surface of an adjacent electrode in the stack to provide a sparkover zone embodying a spark gap, and means for insulating the opposed surface of at least one of the electrodes in the gap units, except for the surface thereof in the sparkover zone whereby wandering of arcs from said sparkover zone onto adjacent surfaces of the electrodes during sparkover is prevented.

2. A surge arrester according to claim 1 wherein the end electrodes in the stack are each provided with only one projection and at least some of the intermediate electrodes are provided with two oppositely extending projections.

3. A surge arrester according to claim 1 wherein at least one of the electrodes in each gap unit is composed of thin sheet metal and is provided with at least one projection that is an integral portion of the metal of the electrode displaced from the general plane of the electrode.

4. A surge arrester according to claim 1 embodying a plurality of electrode plates, each comprising a flat plate having a centrally disposed metallic button secured thereto, said button having portions extending in opposite directions from the plane of the plate to provide projections thereon.

5. A surge arrester according to claim 4 wherein the electrode discs are circular and the projections extend from either side of at least some of the electrode discs at the center thereof.

6. A surge arrester according to claim 1 wherein the plates provided with projections are disposed alternately with flat plates to provide a series of gap units.

7. A surge arrester according to claim 6 in which the surfaces of the plates having projections are provided with insulating barriers covering substantially the entire surfaces of the plates except for the projections and the surfaces of the intermediate plates are not insulated.

8. A surge arrester according to claim 1 wherein the means for insulating exposed surfaces of electrodes having a projection thereon comprises a thin disc of insulating material having an opening through which the projection of the associated electrode extends.

9. A surge arrester according to claim 8 wherein the insulating means for the electrodes of the stack having projections thereon comprises an insulating disc disposed on each side of the electrode, the said insulating discs and electrode with which they are associated being secured together as a sub-assembly.

10. A surge arrester according to claim 1 wherein the end electrodes of the stack have only one projection and the insulating means comprises a disc composed of insulating material secured to the side of the electrode from which the projection extends, the opposite side of the electrode being uninsulated.

11. A surge arrester according to claim 1 wherein the spacer members comprise separately formed buttons of insulating material that are spaced apart circumferentially of the electrodes and directly engage the surfaces of the electrodes between which they are interposed.

12. A surge arrester according to claim 11 wherein the discs of insulating material are apertured to receive the spacer members.

13. A surge arrester according to claim 1 wherein at least one of the spacer members in the stack is composed of a resistive material to provide a grading resistor for the arrester.

14. A surge arrester according to claim 11 wherein at least one of the electrodes is provided with a small projection that projects from the surface of the electrode in the same direction as but for a substantially smaller distance than the projection that forms part of a spark gap, said small projection engaging an end surface of one of said spacer members, said spacer member so engaged having a length less than the other spacer members disposed between the same electrodes by an amount substantially equal to the distance that said small projection extends from the surface of the electrode whereby to provide pre-ionizing means between the electrode having the small projection and an adjacent electrode.

15. A surge arrester according to claim 8 wherein the insulating discs in the stack of electrodes and discs have a diameter slightly greater than the diameter of the electrodes.

16. A surge arrester according to claim 15 wherein the assembly of electrodes, insulating discs, spacers, is enclosed within a cylindrical housing composed of insulating material.

17. A surge arrester comprising a porcelain housing having a cylindrical bore, metal end members secured to said housing and closing the ends of said bore, a valve block disposed in the bore and a gap assembly disposed in the bore, means for connecting the valve block and gap assembly in series between said metal end members, said gap assembly providing a plurality of spark gaps in series and comprising a plurality of substantially flat metal plate electrodes disposed in a stack within said bore, said electrodes having a diameter slightly less than the interior diameter of said bore, insulating spacer members interposed between adjacent electrodes for spacing the electrodes a predetermined distance from each other in the stack, the spacer members comprising separately formed buttons of insulating material that are spaced apart circumferentially of the electrodes and directly engage the surfaces of the electrodes between which they are interposed, each electrode being composed of thin sheet metal and having a projection extending therefrom, the projection being integral with the remainder of the electrode and being formed of a portion of the metal of the electrode displaced from the general plane of the electrode, the projection being disposed in opposition to a projection of an adjacent electrode in the stack to provide a spark gap, a thin disc of insulating material engaging the surface of the electrode from which the projection extends and having an opening through which the projection of the associated electrode extends, the diameter of the disc of insulating material being slightly greater than the diameter of the electrode and the peripheral edges of the discs of insulating material lightly engaging the interior bore of the housing, the discs of insulating material being apertured to receive the spacer buttons whereby the spacer buttons directly engage the surfaces of the electrodes, the end electrodes of the electrode or gap assembly having one projection extending therefrom and having one insulating disc secured to the electrode on the side thereof from which the projection extends, the intermediate electrodes of the gap assembly having two spaced oppositely extending projections extending therefrom and having an insulating disc secured to each side of the said intermediate electrode.

18. A surge arrester according to claim 17 in which at least one of said spacer members is composed of resistive material to provide a grading resistor between two adjacent electrodes.

19. A surge arrester according to claim 18 wherein at least one of the electrodes is provided with a small projection extending from the surface thereof into engagement with a spacer member to provide pre-ionizing means for the gap between the electrodes having the projection and an adjacent electrode.

* * * * *

UNITED STATES PATENT AND TRADEMARK OFFICE

CERTIFICATE OF CORRECTION

PATENT NO. : 3,973,172

DATED : August 3, 1976

INVENTOR(S) : Arnold G. Yost

It is certified that error appears in the above-identified patent and that said Letters Patent are hereby corrected as shown below:

Column 2, line 46, after "several" change "of" to --or--.

Column 3, line 46, after "23" change the period (.) to a comma (,) .

Column 5, line 46, after "fiber" change "of" to --or--.

Column 6, line 30, change "1,375" to --1.375--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*